United States Patent [19]

Ingersoll

[11] 4,014,306

[45] Mar. 29, 1977

[54] GASOLINE VAPORIZER APPARATUS

[75] Inventor: Elmer Wayne Ingersoll, Paola, Kans.

[73] Assignee: Glenn L. Brown, Osawatomie, Kans.

[22] Filed: Apr. 14, 1975

[21] Appl. No.: 567,741

[52] U.S. Cl. ..... 123/141; 48/180 S; 261/79 R

[51] Int. Cl.[2] ..... F02M 29/00

[58] Field of Search ..... 123/141; 48/180 R, 180 M, 48/180 S, 180 B; 261/79 R

[56] References Cited

UNITED STATES PATENTS

| | | | |
|---|---|---|---|
| 1,153,077 | 9/1915 | Hippel | 123/141 |
| 1,213,911 | 1/1917 | Schmid | 123/141 |
| 1,312,660 | 8/1919 | Winslow | 123/141 X |
| 1,625,281 | 4/1927 | Raque et al. | 123/141 X |
| 2,216,722 | 10/1940 | Denson | 123/141 X |
| 2,639,230 | 3/1953 | Lefebre | 123/141 X |
| 2,665,892 | 1/1954 | Rumpler | 123/141 X |

FOREIGN PATENTS OR APPLICATIONS

| | | | |
|---|---|---|---|
| 359,062 | 10/1931 | United Kingdom | 123/141 |
| 568,085 | 3/1945 | United Kingdom | 123/141 |

*Primary Examiner*—C. J. Husar
*Assistant Examiner*—Ira S. Lazarus
*Attorney, Agent, or Firm*—Fishburn, Gold & Litman

[57] ABSTRACT

A gasoline vaporizer apparatus to be interposed between a carburetor and an intake manifold of an internal combustion engine comprises a housing having the carburetor supported on one end and the other end connected to the intake manifold and having a first chamber and a second chamber therein. A first plurality of passages each communicate the first chamber with the second chamber and a second plurality of passages each communicate the second chamber with the intake manifold. A rotor is mounted in the second chamber for rotation in response to suction at the intake manifold effected by intake strokes of pistons of the combustion engine. The rotor has a plurality of generally L-shaped passages therethrough to receive gasoline from the first plurality of passages and discharge vaporized gasoline into the second chamber.

12 Claims, 6 Drawing Figures

GASOLINE VAPORIZER APPARATUS

The present invention relates to gasoline vaporizer apparatus to be interposed between a carburetor and an intake manifold of internal combustion engine and more particularly to a gasoline vaporizer apparatus having an air fuel passge and an action member movably mounted therein and operative to improve vaporizing of gasoline upon movement thereof in response to suction at the intake manifold effected by intake strokes of the pistons of the combustion engine.

Many attempts have been made to improve internal combustion engine performance and to effect vaporizing of gasoline for improved burning thereof. However, all either heat the vaporizing apparatus or do not attempt to alter the temperature thereof.

The principal objects of the present invention are: to provide a gasoline vaporizer apparatus particularly adapted for use on a four cycle multiple cylinder engine having an intake manifold and to be positioned between the manifold and intake valves of the engine and operative to improve combustion of fuel and to effect the cooling of same during vaporization and delivery to an intake manifold of an internal combustion engine; to provide such a gasoline vaporizer apparatus operative to improve vaporization of fuel and substantially increased efficiency of the internal combustion engine; to provide such a gasoline vaporizer apparatus wherein the vaporized fuel is more completely burned within the internal combustion engine whereby the exhaust therefrom is substantially pollution-free; to provide such a gasoline vaporizer which is operative to substantially eliminate carbon build-up during fuel burning in the internal combustion engine whereby the lubricating oil is substantially cleaner; to provide such a gasoline vaporizer which is operative to substantially increase spark plug life and improve operation thereof due to more complete burning of fuel; to provide such a gasoline vaporizer which is effective to substantially lower operating temperature of a combustion engine and thereby substantially increase the efficiency thereof; and to provide such a gasoline vaporizer which is economical to manufacture, durable in construction, positive in operation, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include an exemplary embodiment of the present invention and illustrate various objects and features of the gasoline vaporizer apparatus.

Figure 1:
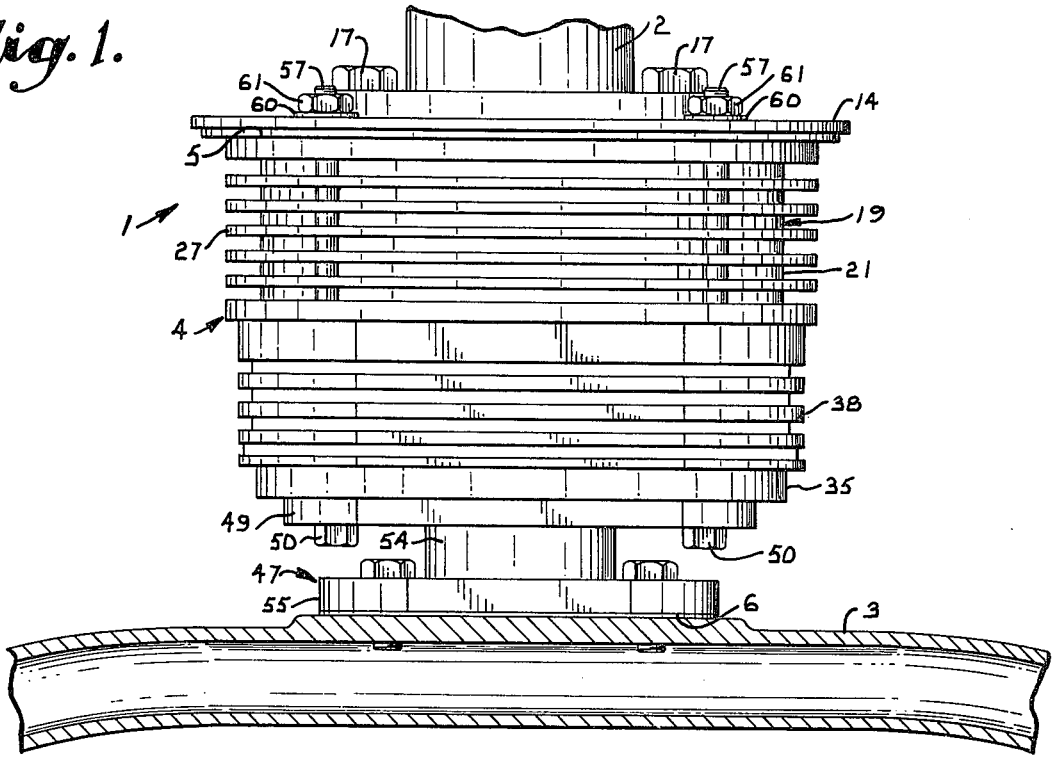
FIG. 1 is a side elevational view of a gasoline vaporizer apparatus embodying features of the present invention.
Figure 2:
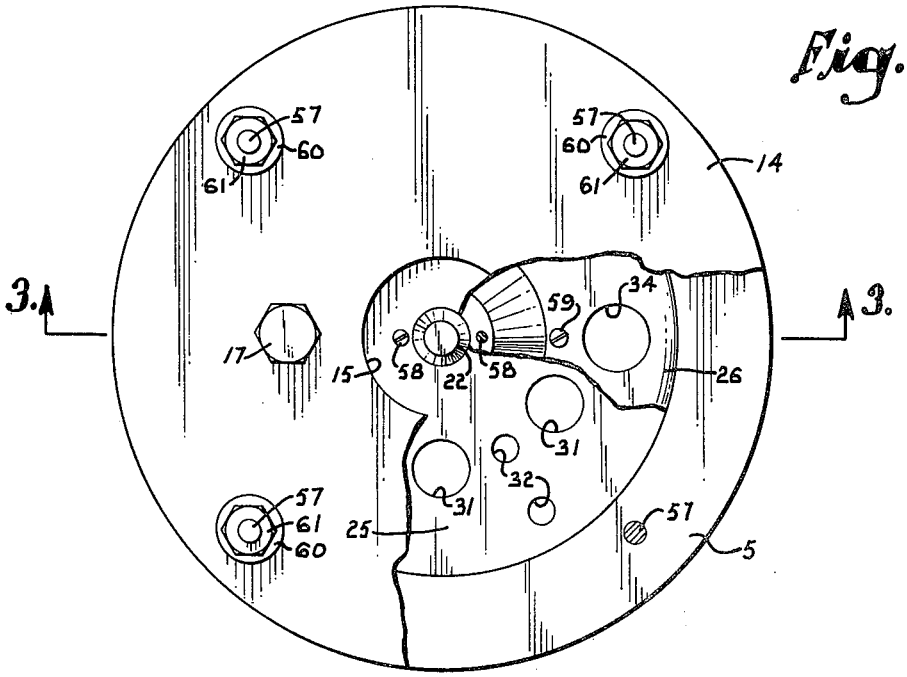
FIG. 2 is a top plan view of the gasoline vaporizer apparatus with portions broken away to better illustrate component parts.
Figure 3:
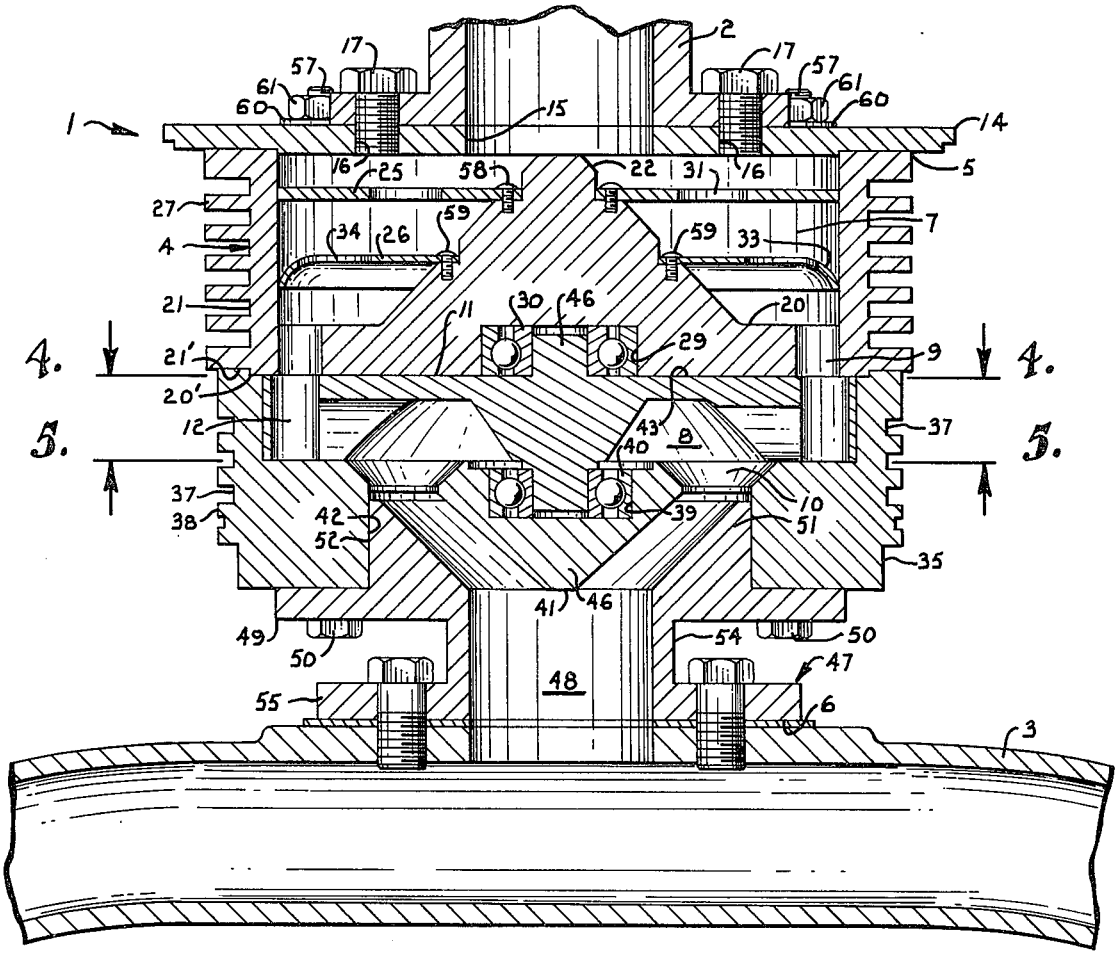
FIG. 3 is an enlarged longitudinal sectional view taken on line 3—3 of FIG. 2.
Figure 4:
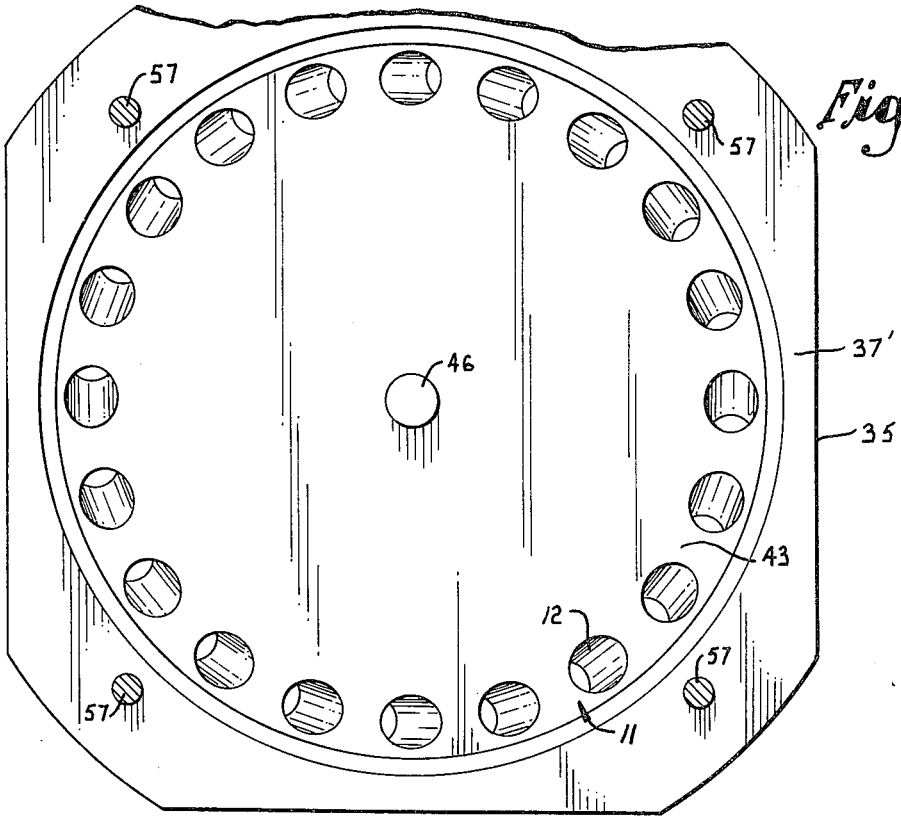
FIG. 4 is an enlarged transverse sectional view taken on line 4—4 of FIG. 3 and showing one surface of a rotor.
Figure 5:
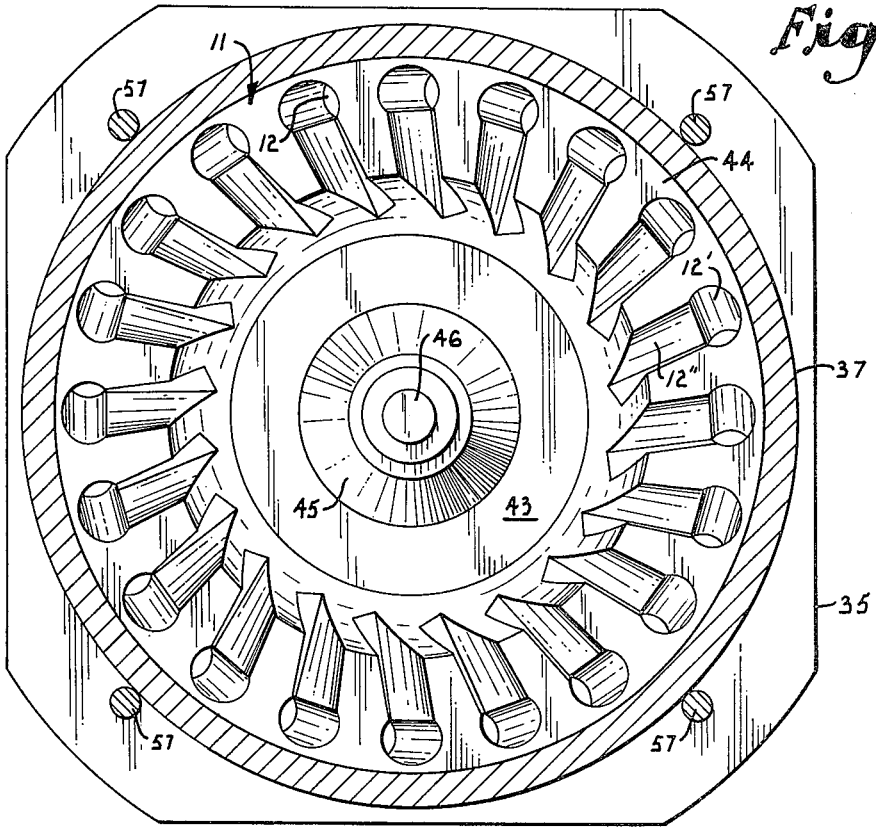
FIG. 5 is an enlarged transverse sectional view taken on line 5—5 of FIG. 3 and showing an other surface of the rotor.
Figure 6:
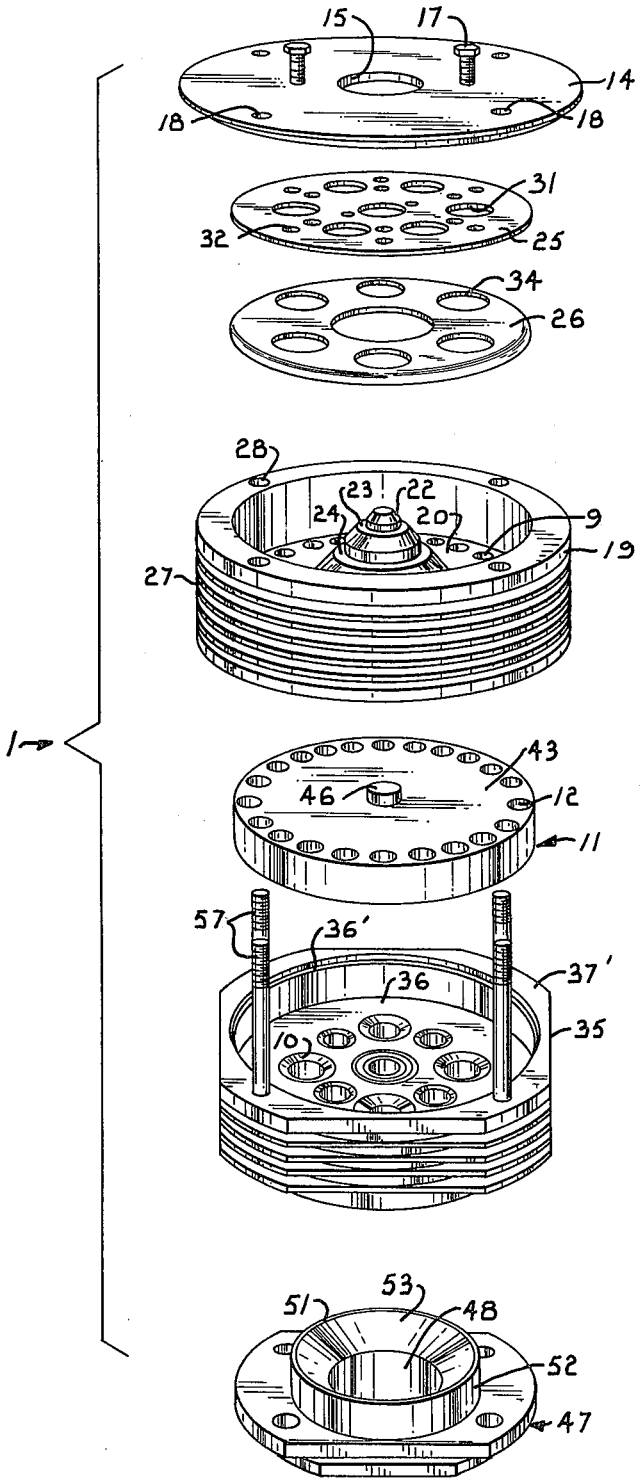
FIG. 6 is an exploded perspective view showing component parts of the gasoline vaporizer apparatus and shown on a reduced scale.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring more in details to the drawings:

In the disclosed embodiment of the present invention, the reference numeral 1 designates generally a gasoline vaporizer apparatus to be interposed between a carburetor 2 and an intake manifold 3 of an internal combustion engine. The gasoline vaporizer apparatus 1 includes a housing 4 having the carburetor 2 supported on one end 5 and the other end 6 thereof connected to the intake manifold 3. The housing 4 has an air-fuel mixture passage therethrough with a movable actuator therein to increase turbulence and improve vaporization of the gasoline. It is preferred that the passage include chambers and therefore the housing 4 has a first chamber 7 and a second chamber 8 therein. A plurality of first passages 9 each communicate the first chamber 7 with the second chamber 8 and a plurality of second passages 10 each communicate the second chamber 8 with the intake manifold 3. The actuator shown is a rotor 11 mounted in the second chamber 8 for rotation in response to suction at the intake manifold 3 effected by intake strokes of pistons of internal combustion engine. The rotor 11 has a plurality of generally L-shaped passages 12 therethrough to receive gasoline from the first passages 9 and discharge vaporized gasoline into the second chamber 8.

In the illustrated structure, the one end 5 of the housing 4 includes a carburetor support portion or member 14 adapted to have the carburetor 2 mounted thereon. The support member 14 is a generally circular planar member having a substantially axial passage 15 therethrough to receive gasoline from the carburetor 2 and permit flow thereof into the first chamber 7. The carburetor support member 14 has a pair of threaded apertures 16 adapted to receive suitable screws or bolts 17 extending through an end flange of the carburetor 2. A plurality of apertures 18 are positioned adjacent the periphery of the carburetor support member 14, for a purpose later described.

The housing 4 includes a first portion 19 in engagement with the carburetor support member 14 and having an end wall 20 spaced from said member 14. The first portion 19 has a side wall 21 extending from the end wall 20 to define the first chamber 7. The side wall 21 is generally cylindrical and the end wall 20 has an end surface with the first passages 9 extending therethrough. The end surface of the end wall 20 is substantially normal to a longitudinal axis of the gasoline vaporizer apparatus 1.

The first passages 9 each have an axis positioned to define an acute angle between the end surface of the end wall 20 and the axis of the respective passage. The angle is in the range of 55° to 75°.

The first housing portion 19 has means mounted on the end wall 20 thereof and extending therefrom for directing gasoline from the carburetor 2 toward the passages 9 through the end wall 20. In the illustrated structure, an upstanding portion 22 is mounted on or integral with the end wall 20, said portion 22 being generally conical in shape and coaxial with a longitudinal axis of the gasoline vaporizer apparatus with an upper end of portion 22 centered relative to the passage 15. The upstanding portion 22 has upper and lower shoulders 23 and 24 to support and mount thereon upper and lower baffle members 25 and 26 respectively, as later described.

The side wall 21 has a plurality of fins 27 extending outwardly therefrom and the fins 27 have a plurality of circumferentially spaced and aligned apertures 28 therethrough which longitudinally align with respective apertures 18 in the carburetor support member 14, for a purpose later described.

The end wall 20 has a recess 29 in a lower end surface thereof and the recess 29 having a suitable bearing 30 therein and positioned on the longitudinal axis of the gasoline vaporizer apparatus 1. The end wall 20 has a portion 20′ thereof depending from the side wall 20 to define a shoulder 21′, for a purpose later described.

The upper baffle member 25 is a generally planar circular member having a peripheral edge thereof positioned adjacent an interior surface of the side wall 21. The upper baffle member 25 has a center aperture adapted to receive the upstanding portion 22 therein and has a first and second plurality of apertures 31 and 32 circumferentially spaced in respective annular rings to permit gasoline flow therethrough.

The lower baffle member 26 is also a generally planar circular member having an arcuate peripheral edge portion 33 positioned adjacent the interior surface of the side wall 21 of the first housing portion 19. The lower baffle member 26 has a center aperture adapted to receive the upstanding portion 22. The lower baffle member 26 has a plurality of circumferentially spaced apertures 34 to permit gas to flow therethrough toward the first passages 9 through the end wall 20.

The housing 4 includes a second housing portion 35 in engagement with the first housing portion 19 and having an end wall 36 spaced from the end wall 20 of the first portion 19 and a side wall 37 extending therefrom to define the second chamber 8. The end wall 36 of the second housing portion 35 has the plurality of second passages 10 extending therethrough. The side wall 37 is generally cylindrical and has a recess 36′ in an end surface or edge 37′ thereof to receive the end portion 20′ of the housing portion 19. The end edge 37′ of the side wall 37 is in engagement with the shoulder 21′. The side wall 37 of the housing portion 35 also has a plurality of fins 38 extending outwardly therefrom.

The end wall 36 of the second housing portion 35 has a recess 39 in the upper surface thereof which is in facing relation with the lower end surface of the end wall 20 of the first housing portion 19. The recess 39 is adapted to receive therein a suitable bearing 40 positioned on the longitudinal axis of the gasoline vaporizer apparatus 1 and coaxially aligned with the bearing 30, for a purpose later described.

In the illustrated structure, the end wall 36 has a center portion 41 of a generally conical shape converging downwardly toward the longitudinal axis of the gasoline vaporizer apparatus 1. An interior surface 42 of a lower portion of the side wall 37 is substantially parallel with the longitudinal axis of the gasoline vaporizer apparatus 1 and spaced from the surface of the center portion 41 to define a third chamber, for a purpose later described. The second passages 10 extend through the end wall 36 and communicate the chamber 8 with the third chamber.

The rotor 11 has an end wall 43 with a surface thereof positioned adjacent and in facing relation with a lower surface of the end wall 20 of the housing portion 19. The end surface of the end wall 43 is substantially normal to a longitudinal axis of the gasoline vaporizer apparatus 1. The rotor 11 has a side wall portion 44 having an exterior surface thereof positioned adjacent and in facing relation with the interior surface of an upper portion of the side wall 37 defining the chamber 8. The rotor 11 has a generally conical shaped center portion 45 spaced from and having an exterior surface thereof substantially parallel with the interior surface of the side wall portion 44 to define a chamber within the rotor 11.

The rotor 11 has an axle 46 aligned with the longitudinal axis of the gasoline vaporizer apparatus 1 and having opposite ends thereof rotatably received in the bearings 30 and 40 in the end walls 20 and 36 of the first and second housing portions 19 and 35 respectively.

The passages 12 through the rotor 11 are circumferentially spaced and each have an entrance portion 12′ alignable with a respective one of the passages 9 through the end wall 20 of the housing portion 19. The entrance 12′ of each of the passages 12 through the rotor 11 has an axis positioned to define an acute angle between the respective axis and the end surface of the rotor 11. The acute angle between the axis of each of the entrance portions and the end surface of the rotor is in the range of 55° to 75°.

The passages 12 through the rotor 11 each have an exit portion 12″ communicating with the chamber within the rotor 11 whereby the passages 12 are generally L-shaped.

The exit portion 12″ of each of the passages 12 through the rotor 11 has an axis positioned to define an acute angle between the respective axis and a line extending radially from the axis of rotation of the rotor and intersecting the respective axis. The acute angle between the axis of each of the exit portions 12″ and the respective line extending radially from the axis of rotation of the rotor 11 is in the range of 50° to 75°.

The other or lower end 6 of the housing 4 includes a mounting member 47 in engagement with the second housing portion 35 and adapted to be connected to the intake manifold 3 of a combustion engine (not shown). The mounting member 47 has a passage 48 therethrough adapted to receive vaporized gasoline from the chamber 8, by means of the passages 10 and the third chamber.

The mounting member 47 has a first flange 49 in engagement with the end wall 36 of the second housing 35 and suitably connected thereto, as by screws 50.

The mounting member 47 has a projection 51 adapted to be received in the third chamber. The projection 51 has an exterior surface 52 in engagement with the interior surface 42 of the lower portion of the side wall 37. The projection 51 has an interior surface 53 spaced from and substantially parallel with an exterior surface of the center portion 41 of the end wall 36 to define an annular passage communicating with the passage 48 through a tubular portion 54 of the mounting member 47.

The tubular portion 54 has a second flange 55 on the other end thereof and adapted to be connected to the intake manifold 3 of a combustion engine (not shown), as by suitable screws 56.

Assembly of the components of the gasoline vaporizer apparatus 1 includes connecting the mounting member 47 and the second housing portion 35 together, as by the screws 50. The lower end of the axle 46 of the rotor 11 is positioned in the bearing 40 with the rotor 11 within the second chamber 8. The second housing portion 35 has a plurality of threaded shafts 57 extending from the side wall 37 and through the apertures 28 in the fins 27 of the first housing portion 19 and through the apertures 18 of the carburetor support member 14 during positioning of the first housing portion 19 on the second housing portion 35. An upper end of the axle 46 of the rotor 11 is received in the bearing 30 in the lower surface of the end wall 20. The baffle members 25 and 26 are suitably secured to the upstanding portion 22 of the end wall 20, as by suitable screws 58 and 59. Suitable washers 60 and nuts 61 are mounted on the ends of the shafts 57 for retaining the carburetor support member 14 in engagement with the upper ends of the side wall 21.

Flow of air and gasoline from the carburetor 2 through the gasoline vaporizer apparatus 1 is into the first chamber 7 and through the apertures 31 and 32 of the upper baffle member 25 and through the apertures 34 of the lower baffle member 26. Air and gasoline flow through the inclined first passages 9 in the end wall 20 and is received in the entrance portion of respective passages 12 in the rotor 11. Rotation of the rotor 11 as by the drawing of the air and gasoline therethrough due to suction at the intake manifold 3 of the combustion engine (not shown) facilitates vaporization of the gasoline for discharge of the vapors from the exit portion 12'' of the passages 12 into the chamber within the rotor 11. The air and vaporized gasoline flows through the second passages 10 in the end wall 36 of the second housing portion 35 and into and through the third chamber and into the passage 48 in the mounting member 47 for delivery to the intake manifold 3.

It is to be understood that while I have illustrated and described one form of my invention, it is not to be limited to the specific form or arrangement of parts herein described and shown.

What I claim and desire to secure by Letters Patent is:

1. A gasoline vaporizer apparatus to be interposed between a carburetor and an intake manifold of a combustion engine and comprising:

a. a carburetor support member adapted to have a carburetor mounted thereon, said support member having a passage therethrough adapted to receive gasoline from the carburetor;

b. a first housing portion in engagement with said carburetor support member and having an end wall spaced from said carburetor support member and having an end wall spaced from said carburetor support member and a side wall extending therefrom to define a first chamber, said end wall of said first housing having a plurality of passages therethrough;

c. a second housing portion in engagement with said first housing portion and having an end wall spaced from said end wall of said first housing portion and a side wall extending therefrom to define a second chamber, said end wall of said second housing having a plurality of passages therethrough;

d. a mounting member in engagement with said second housing portion and adapted to be connected to an intake manifold of a combustion engine, said mounting member having a passage therethrough adapted to receive vaporized gasoline from the second chamber; and e. a rotor having an axis of rotation and mounted in the second chamber for rotation in response to at least a partial vacuum effected by a combustion engine, said rotor having a plurality of passages therethrough adapted to receive gasoline from the passages through said end wall of said first housing and direct vaporized gasoline into the second chamber, said passages through said rotor each being radially outwardly spaced from the axis of rotation of said rotor, said passages through said rotor each having an entrance portion alignable with a respective one of said passages through said end wall of said first housing portion, said passages through said rotor each having an exit portion intersecting said respective entrance portion and extending inwardly from said entrance portion thereof and communicating with said second chamber, said exit portion of each of said passages through said rotor being outwardly of said passages through said end wall of said second housing portion, said passages through said rotor each being generally L-shaped.

2. A gasoline vaporizer apparatus as set forth in claim 1 including baffle members mounted in the first chamber between said carburetor support member and said end wall of said first housing, said baffle members each having a plurality of passages therethrough.

3. A gasoline vaporized apparatus as set forth in claim 1 wherein:

a. said plurality of passages through said end wall of said first housing portion are circumferentially spaced and positioned adjacent said side wall of said first housing portion;

b. said passages through said end wall of said first housing portion each have an axis positioned to define an acute angle between a surface normal to the axis of rotation of said rotor and the axis of the respective passage through said end wall of said first housing portion;

c. said rotor has means defining an annular chamber therein;

d. said plurality of passages through said rotor each have said exit portion thereof communicating with the annular chamber in said rotor.

e. said plurality of passages through said rotor are each generally L-shaped.

4. A gasoline vaporizer apparatus as set forth in claim 1 including:

a. means mounted on said end wall of said first housing portion and extending therefrom for directing gasoline from the carburetor toward said passages through said end wall of said first housing portion; and b. baffle members mounted in the first chamber between said carburetor support member and said end wall of said first housing portion and each having a plurality of passages therethrough.

5. A gasoline vaporizer apparatus as set forth in claim 4 wherein:

a. said plurality of passages through said end wall of said first housing portion are circumferentially spaced and positioned adjacent said side wall of said first housing portion;

b. said passages through said end wall of said first housing portion each have an axis positioned to define an acute angle between a surface normal to the axis of rotation of said rotor and the axis of the respective passage through said end wall of said first housing portion;

c. said rotor has means defining an annular chamber therein;

d. said plurality of passages through said rotor each have said exit portion thereof communicating with the annular chamber in said rotor.

6. A gasoline vaporizer apparatus as set forth in claim 5 wherein:

a. said rotor has an end surface adjacent and in facing relation with said end wall of said first housing portion;

b. the entrance portion of each of said passages through said rotor has an axis positioned to define an acute angle between the respective passage axis and the end surface of said rotor; and c. the exit portion of each of said passages through said rotor has an axis positioned to define an acute angle between the respective passage axis and a line extending radially from the axis of rotation of said rotor and intersecting said respective passage axis.

7. A gasoline vaporizer apparatus as set forth in claim 6 wherein:

a. the acute angle between the axis of each of said entrance portions and the end surface of said rotor is in the range of 55° to 75° ; and b. the acute angle between the axis of each of said exit portions and the respective line extending radially from the axis of rotation of said rotor is in the range of 50° to 75°.

8. A gasoline vaporizer apparatus comprising:

a. a carburetor support member adapted to have a carburetor mounted thereon, said support member having a passage therethrough adapted to receive gasoline from a carburetor;

b. a housing in engagement with said carburetor support member;

c. wall means in said housing defining a first chamber and a second chamber, said first chamber communicating with said passage through said support member;

d. means on said housing for mounting same on an intake manifold of a combustion engine;

e. means in said housing defining a first plurality of passages communicating said first chamber with said second chamber and a second plurality of passages communicating said second chamber with the intake manifold; and f. a rotor having an axis of rotation and mounted in said second chamber for rotation in response to at least a partial vacuum effected by a combustion engine, said rotor having a plurality of passages therethrough adapted to receive gasoline from the first chamber and direct vaporized gasoline into the second chamber, said passages through said rotor each being radially outwardly spaced from the axis of rotation of said rotor, said passages through said rotor each having an entrance portion alignable with a respective one of said passages of said first plurality of passages in said housing, said passages through said rotor each having an exit portion intersecting said respective entrance portion and extending inwardly from said entrance portion thereof and communicating with said second chamber, said exit portion of each of said passages through said rotor being outwardly of said second plurality of passages, said passages through said rotor each being generally L-shaped.

9. A gasoline vaporizer apparatus as set forth in claim 8 including:

a. means mounted on said wall means defining said first chamber for directing gasoline from the carburetor to said first plurality of passages; and b. a plurality of baffle members mounted in said first chamber and each having a plurality of passages therethrough.

10. A gasoline vaporizer apparatus as set forth in claim 8 wherein:

a. said housing includes a side wall;

b. said first plurality of passages are circumferentially spaced and positioned adjacent said wall;

c. said second plurality of passages are circumferentially spaced and positioned intermediate said first plurality of passages and the axis of rotation of said rotor;

d. said rotor has means defining an end surface and an annular chamber communicating with said second plurality of passages;

e. said exit portion of said plurality of passages through said rotor each communicate with the annular chamber in said rotor; and f. said chamber in said rotor communicates with said second plurality of passages.

11. A gasoline vaporizer apparatus as set forth in claim 10 wherein:

a. the entrance portion of each of said passages through said rotor has an axis positioned to define an acute angle between the respective passage axis and the end surface of said rotor; and b. the exit portion of each of said passages through said rotor has an axis positioned to define an acute angle between the respective passage axis and a line extending radially from the axis of rotation of said rotor and intersecting said respective passage axis.

12. A gasoline vaporizer apparatus as set forth in claim 11 wherein:

a. the acute angle between the axis of each of said entrance portions and the end surface of said rotor is in the range of 55° to 75°; and b. the acute angle between the axis of each of said exit portions and the respective line extending radially from the axis of rotation of said rotor is in the range of 50° to 75°.

* * * * *